US010132075B2

(12) United States Patent
Banal et al.

(10) Patent No.: US 10,132,075 B2
(45) Date of Patent: Nov. 20, 2018

(54) CORNER ASSEMBLY FOR A PORTABLE SHELTER

(71) Applicant: Sunjoy Industries Group Ltd., Steubenville, OH (US)

(72) Inventors: Sean Michael Banal, Galena, OH (US); Lianzhang Pan, Huzhou (CN)

(73) Assignee: Sunjoy Industries Group Ltd., Steubenville, OH (US)

( * ) Notice: Subject to any disclaimer, the term of this patent is extended or adjusted under 35 U.S.C. 154(b) by 0 days.

(21) Appl. No.: 15/416,020

(22) Filed: Jan. 26, 2017

(65) Prior Publication Data

US 2017/0218617 A1 Aug. 3, 2017

Related U.S. Application Data

(60) Provisional application No. 62/289,312, filed on Jan. 31, 2016.

(51) Int. Cl.
*E04B 1/00* (2006.01)
*E04B 1/343* (2006.01)
(Continued)

(52) U.S. Cl.
CPC ..... *E04B 1/34384* (2013.01); *E04B 1/34321* (2013.01); *E04B 1/34326* (2013.01);
(Continued)

(58) Field of Classification Search
CPC .... E04B 1/34384; E04B 1/34321; E04B 1/40; E04H 1/1205
(Continued)

(56) References Cited

U.S. PATENT DOCUMENTS 1,958,296 A 5/1934 Crow
2,265,479 A 12/1941 Goodman
(Continued)

FOREIGN PATENT DOCUMENTS

JP 2002138713 A 5/2002
WO 9827296 A1 6/1998

OTHER PUBLICATIONS

Use and Care Guide for Lansing Gazebo, Hampton Bay, manufactured by Sunjoy Industries, pp. 1-9, dated Oct. 2002.
(Continued)

*Primary Examiner* — Basil S Katcheves
(74) *Attorney, Agent, or Firm* — The Law Office of Patrick F. O'Reilly III, LLC

(57) ABSTRACT

A corner assembly for a portable shelter is disclosed herein. The corner assembly includes a corner connecting member configured to couple a support post member to one or more roof frame members of a portable shelter; and a corner trim member configured to be coupled to the corner connecting member, the corner trim member configured to be secured to the corner connecting member by a user disposed in the interior of the portable shelter. In one or more embodiments, the corner assembly further includes a support post member, the support post member configured to support a roof frame structure of a portable shelter. The corner connecting member may include a downwardly extending flange configured to extend along an interior surface of the support post member. The corner trim member may be configured to be coupled to the downwardly extending flange of the corner connecting member.

17 Claims, 5 Drawing Sheets

(51) Int. Cl.
*E04B 1/41* (2006.01)
*E04H 1/12* (2006.01)
*E04B 1/58* (2006.01)
*E04B 1/38* (2006.01)

(52) U.S. Cl.
CPC ..... *E04B 1/40* (2013.01); *E04B 1/5831* (2013.01); *E04H 1/1205* (2013.01); *E04B 2001/405* (2013.01)

(58) Field of Classification Search
USPC ..... 52/263, 79.6, 82
See application file for complete search history.

(56) References Cited

U.S. PATENT DOCUMENTS 2,836,860 A 6/1958 Staropoli
3,204,373 A * 9/1965 Small ..... E04B 1/24 52/280
3,333,373 A 8/1967 Taylor et al.
3,952,463 A 4/1976 Lane
4,066,089 A 1/1978 Rainwater
4,229,915 A 10/1980 Snow et al.
4,558,713 A 12/1985 Hagler et al.
4,726,153 A 2/1988 Adler et al.
4,733,508 A 3/1988 Greenblatt
4,914,768 A 4/1990 Howard
4,948,289 A 8/1990 Dellinger
5,115,828 A 5/1992 Spaulding
5,226,440 A 7/1993 Fuhrman
5,335,685 A 8/1994 Dahulich
5,511,572 A 4/1996 Carter
5,579,796 A 12/1996 Mallo et al.
5,632,293 A 5/1997 Carter
5,660,002 A * 8/1997 Lashinger ..... A01G 9/16 52/63
5,661,942 A 9/1997 Palmer
5,779,386 A 7/1998 Eichhorn
6,089,247 A 7/2000 Price
6,173,726 B1 1/2001 Talmadge
6,200,060 B1 3/2001 Vernay
6,206,020 B1 3/2001 Lynch
6,216,717 B1 4/2001 Chen
6,283,136 B1 9/2001 Chen
6,651,685 B2 11/2003 Connelly et al.
6,745,521 B1 6/2004 Klemming
6,761,181 B1 7/2004 Tseng
6,772,780 B2 8/2004 Price
6,814,094 B1 11/2004 Barber
6,820,629 B2 11/2004 Tseng
6,923,195 B2 8/2005 Tseng
7,025,074 B2 4/2006 Porter
7,207,344 B2 4/2007 Wu
7,219,681 B1 5/2007 Hamilton-Jones
7,451,776 B2 11/2008 Chen
7,703,469 B2 4/2010 Danziger
7,814,723 B2 10/2010 VanElverdinghe
7,921,864 B2 4/2011 Carter
8,001,986 B2 8/2011 Shumate
8,082,938 B2 12/2011 Prusmack
9,243,422 B2 1/2016 Hunt et al.
9,556,639 B2 1/2017 Hunt et al.
2004/0206013 A1* 10/2004 Berg ..... A01G 9/16 52/63
2006/0266401 A1 11/2006 Wu
2007/0215191 A1 9/2007 Huang et al.
2009/0064613 A1* 3/2009 Ouyang ..... E04F 19/0436 52/288.1
2009/0314323 A1 12/2009 Park et al.
2010/0275962 A1 11/2010 Park et al.
2011/0308559 A1 12/2011 Ma et al.
2012/0240970 A1 9/2012 Parsons et al.
2013/0240815 A1* 9/2013 Wiegmann ..... A47D 13/061 256/25
2016/0160515 A1* 6/2016 Wallance ..... E04B 1/3483 52/79.1

OTHER PUBLICATIONS

Owner's Manual for Bay Window Gazebo, Garden Oasis Living Outdoors, manufactured by Sunjoy Industries, pp. 1-9, dated Oct. 2006.
11'×13' South Hampton Gazebo Instruction Manual, manufactured by Sunjoy Industries, pp. 1-8, dated Oct. 2004.
11'×13' New Port Gazebo Instruction Manual, manufactured by Sunjoy Industries, pp. 1-7, dated Oct. 2012.
Outdoor Gazebo Model No. L-GZ682PCO-1 Assembly Instructions, manufactured by Sunjoy Industries, pp. 1-9, dated Dec. 2013.

* cited by examiner

CORNER ASSEMBLY FOR A PORTABLE SHELTER

CROSS-REFERENCE TO RELATED APPLICATIONS

This patent application claims priority to, and incorporates by reference in its entirety, U.S. Provisional Patent Application No. 62/289,312, entitled "Corner Assembly for a Portable Shelter", filed on Jan. 31, 2016.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a corner assembly for a portable shelter. More particularly, the invention relates to a corner assembly for a portable shelter comprising constituent components that are capable of being secured to one another from the interior of the portable shelter.

2. Background and Description of Related Art

Portable shelters, such as outdoor gazebos and screen rooms, are useful for a myriad of different applications. For example, portable gazebos and screen rooms are often used for outdoor parties, such as backyard cookouts or tailgate parties at various sporting events. Because the portable gazebos and screen rooms are at least partially enclosed, a food serving table or tables are often placed inside of the gazebo or screen room to protect the food being served at the event from sunlight, rain, and/or insects. Also, dining tables may be arranged underneath the portable gazebo or screen room so that attendees at the party may remain cooler by being shaded from direct sunlight.

Although, many components of conventional portable shelters often require assembly by a user from outside of the portable shelter. When components are required to be assembled by the user on the outside of the portable shelter, it is frequently difficult to properly align the components as they assembled, thereby resulting in an undesirable loose fit between various components of the portable shelter. Moreover, when the components of portable shelters are required to be assembled from outside the enclosure, it is often difficult to adjust the components in the manner that is needed to ensure that the components are securely engaged with one another. Furthermore, the aesthetics of the portable shelters are detrimentally affected when fasteners are visible from outside the portable shelter. Also, these exteriorly located fasteners are not protected from the elements (e.g., rain, snow, etc.), and thus are subject to deterioration and corrosion.

Therefore, what is needed is a corner assembly for a portable shelter that includes a plurality of components that are capable of being assembled from the interior of the portable shelter so that it is easier to align the components as they are assembled. Also, a corner assembly for a portable shelter is needed which comprises a plurality of components that are capable of being assembled from inside the portable shelter so that adjustments may be readily made to the components as they are assembled. In addition, a corner assembly for a portable shelter is needed that does not necessitate the use of exteriorly located fasteners, thereby enabling the fasteners to be protected from the weather elements and the portable shelter to have an aesthetically pleasing exterior appearance.

BRIEF SUMMARY OF EMBODIMENTS OF THE INVENTION

Accordingly, the present invention is directed to a corner assembly for a portable shelter that substantially obviates one or more problems resulting from the limitations and deficiencies of the related art.

In accordance with one or more embodiments of the present invention, there is provided a corner assembly for a portable shelter, which includes a support post member, the support post member configured to support a roof frame structure of a portable shelter; a corner connecting member configured to be coupled to the support post member, the corner connecting member including a downwardly extending flange configured to extend along an interior surface of the support post member; and a corner trim member configured to be coupled to the downwardly extending flange of the corner connecting member, the corner trim member configured to be secured to the corner connecting member by a user disposed in the interior of the portable shelter.

In a further embodiment of the present invention, the corner trim member comprises a fastener boss extending from a rear surface of the corner trim member, and the support post member comprises an aperture disposed therethrough, the aperture of the support post member configured to receive the fastener boss of the corner trim member therein.

In yet a further embodiment, the fastener boss of the corner trim member comprises a centrally disposed fastener aperture formed therein, the centrally disposed fastener aperture configured to receive a fastener member for securing the corner trim member to the downwardly extending flange of the corner connecting member.

In still a further embodiment, the fastener boss of the corner trim member is configured to extend between ends of adjacent side trim members of the portable shelter when the corner trim member is secured to the corner connecting member.

In yet a further embodiment, the corner trim member comprises a generally L-shaped trim member formed by a first trim portion and a second trim portion, the first trim portion being disposed generally perpendicular to the second trim portion, and wherein the fastener boss extends from the intersection line between the first and second trim portions.

In still a further embodiment, the support post member comprises one or more fastener apertures in a top end thereof, and wherein the corner connecting member further comprises one or more base mounting flanges with one or more mounting apertures therein, each of the one or more mounting apertures in the one or more base mounting flanges of the corner connecting member configured to correspond to the one or more fastener apertures in the top end of the support post member.

In yet a further embodiment, the corner connecting member further comprises a roof frame mounting tray configured to support one or more roof frame members of the roof frame structure of the portable shelter therein.

In still a further embodiment, the corner connecting member further comprises at least one side mounting flange for coupling the corner connecting member to a roof bracket member.

In accordance with one or more other embodiments of the present invention, there is provided a corner assembly for a portable shelter, which includes a corner connecting member configured to couple a support post member to one or more roof frame members of a portable shelter; and a corner trim member configured to be coupled to the corner connecting member, the corner trim member configured to be secured to the corner connecting member by a user disposed in the interior of the portable shelter.

In a further embodiment of the present invention, the corner trim member comprises a fastener boss extending from a rear surface of the corner trim member, the fastener boss of the corner trim member configured to extend through an aperture disposed through the support post member.

In yet a further embodiment, the fastener boss of the corner trim member comprises a centrally disposed fastener aperture formed therein, the centrally disposed fastener aperture configured to receive a fastener member for securing the corner trim member to the corner connecting member.

In still a further embodiment, the fastener boss of the corner trim member is configured to extend between ends of adjacent side trim members of the portable shelter when the corner trim member is secured to the corner connecting member.

In yet a further embodiment, the corner trim member comprises a generally L-shaped trim member formed by a first trim portion and a second trim portion, the first trim portion being disposed generally perpendicular to the second trim portion, and wherein the fastener boss extends from the intersection line between the first and second trim portions.

In still a further embodiment, the corner connecting member comprises one or more base mounting flanges with one or more mounting apertures therein, each of the one or more mounting apertures in the one or more base mounting flanges of the corner connecting member configured to correspond to one or more fastener apertures in a top end of the support post member.

In yet a further embodiment, the corner connecting member comprises a roof frame mounting tray configured to support the one or more roof frame members of the portable shelter therein.

In still a further embodiment, the corner connecting member comprises at least one side mounting flange for coupling the corner connecting member to a roof bracket member.

In yet a further embodiment, the corner connecting member comprises a downwardly extending flange for coupling the corner connecting member to the corner trim member.

In accordance with yet one or more other embodiments of the present invention, there is provided a corner assembly for a portable shelter, which includes a support post member having an inner surface configured to be disposed on an interior of a portable shelter, the support post member configured to support a roof frame structure of the portable shelter; and a corner trim member configured to be coupled to the support post member, the corner trim member configured to be coupled to the inner surface of the support post member by a user disposed in the interior of the portable shelter.

In a further embodiment of the present invention, the corner trim member comprises a fastener boss extending from a rear surface of the corner trim member, and wherein the support post member comprises an aperture disposed therethrough, the aperture of the support post member configured to receive the fastener boss of the corner trim member therein.

In yet a further embodiment, the fastener boss of the corner trim member comprises a centrally disposed fastener aperture formed therein, the centrally disposed fastener aperture configured to receive a fastener member for coupling the corner trim member to the inner surface of the support post member.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

Figure 1:
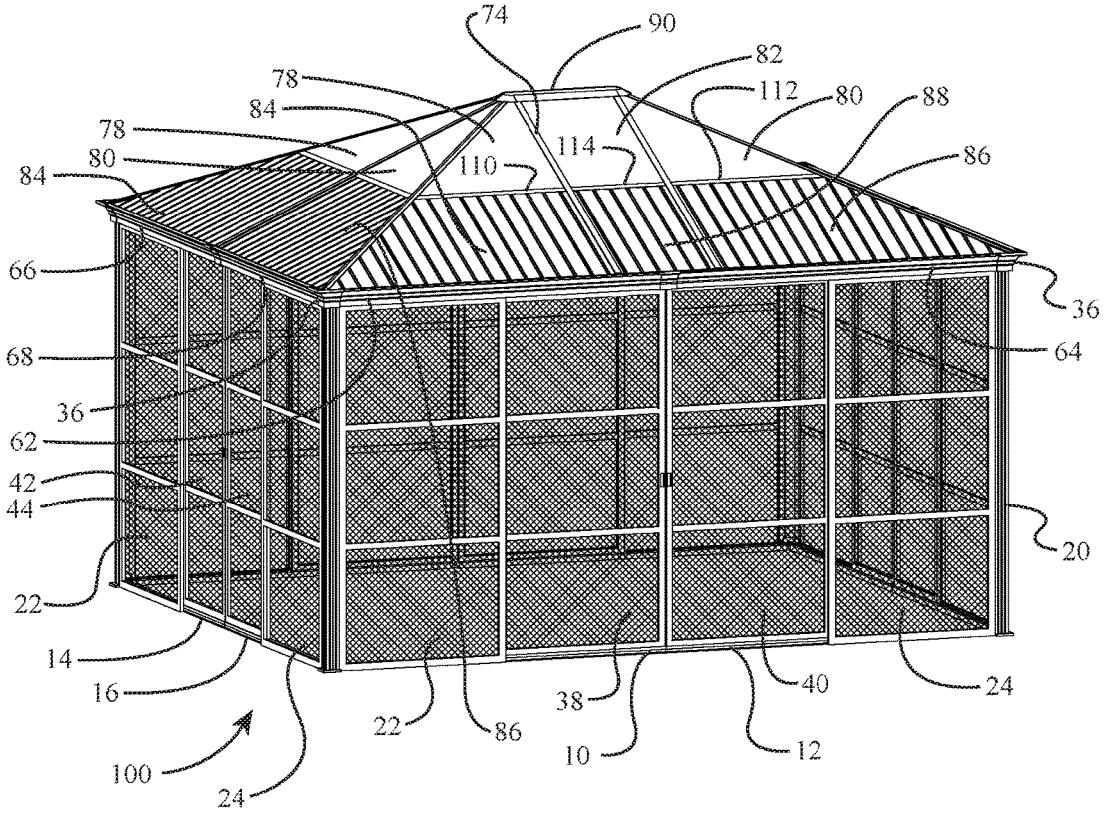
FIG. 1 is a perspective view of a portable shelter, according to an embodiment of the invention, wherein the portable shelter is illustrated in its assembled state.
Figure 2:
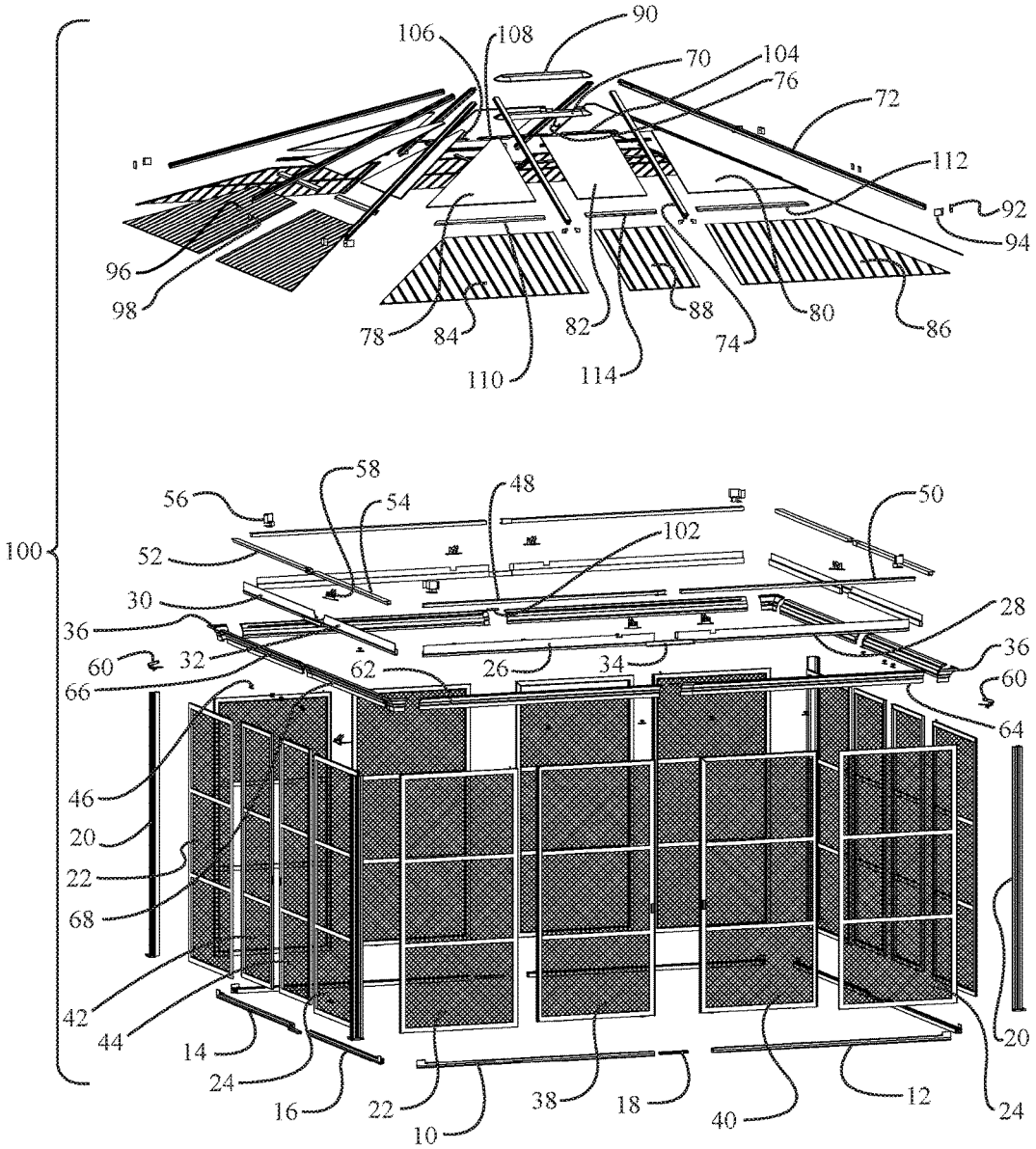
FIG. 2 is another perspective view of the portable shelter of FIG. 1, wherein the portable shelter is illustrated in its exploded state.

An exemplary embodiment of the portable shelter or screen room is seen generally at 100 in FIGS. 1 and 2. Initially, referring collectively to the assembled perspective view of FIG. 1 and the exploded perspective view of FIG. 2, it can be seen that the frame system of the portable shelter 100 generally comprises a plurality of vertical support members (e.g., corner support post members 20); a plurality of crossbeam frame members 26, 28, 30, 32, each of the crossbeam frame members 26, 28, 30, 32 configured to be disposed between a pair of the plurality of corner support post members 20; and a plurality of roof frame members 72, 74, each of the roof frame members 72, 74 configured to be coupled to one of the plurality of corner support members 20 or one of the plurality of crossbeam frame members 26, 28, 30, 32.

As shown in FIGS. 1 and 2, the vertical support members of the portable shelter framing system of the illustrated embodiment are in the form of corner support post members 20. With reference to the connection detail of FIG. 3, it can be seen that each corner post support member 20 has a respective corner connecting member 60 mounted thereto. As will be explained in more detail hereinafter, the corner connecting members 60 connect the corner roof frame members 72 to the corner support post members 20.

Now, with reference primarily to the exploded view of FIG. 2, the crossbeam frame members 26, 28, 30, 32 will be described in detail. As best shown in the exploded perspective view of FIG. 2, the portable shelter framing system of the portable shelter 100 includes a first pair of crossbeam frame members 26, 28 and a second pair of crossbeam frame members 30, 32. The first pair of crossbeam frame members 26, 28 are essentially the same as the second pair of crossbeam frame members 30, 32, except that the crossbeam frame members 26, 28 have a longer length than the crossbeam frame members 30, 32 (the portable shelter or screen room 100 has a generally rectangular shape with two longer sides and two shorter sides). Referring again to FIG. 2, it can be seen that the longer crossbeam frame members 26, 28 are connected to one another by means of a middle connecting member 34. Similarly, the shorter crossbeam frame members 30, 32 are also connected to one another by means of a middle connecting member 34. A pair of spaced-apart middle connecting members 58 are mounted to each first pair of crossbeam frame members 26, 28 for coupling a pair of middle roof frame members 74 to the crossbeam frame members 26, 28 (see FIG. 2). A single middle connecting member 58 is mounted to each second pair of crossbeam frame members 30, 32 for coupling a single middle roof frame member 74 to the crossbeam frame members 30, 32.

Next, with reference to primarily to FIGS. 3-8, the corner assemblies at the four (4) corners of the exemplary portable shelter 100 will be explained in detail. Initially, as depicted in FIG. 6, each of the four (4) corner assemblies of the portable shelter 100 generally includes a corner support post member 20, the corner support post member 20 supporting a roof frame structure of a portable shelter 100 (e.g., a corner roof frame member 72 of the roof frame structure—see FIG. 4); a corner connecting member 60 coupled to the support post member 20, the corner connecting member 60 including a downwardly extending flange 120 that extends along an interior surface of the corner support post member 20 when the corner connecting member 60 is attached thereto (see FIG. 6); and a corner trim member 36 coupled to the downwardly extending flange 120 of the corner connecting member 60, the corner trim member 36 being secured to the corner connecting member 60 by a user disposed in the interior of the portable shelter 100. Advantageously, as explained in more detail hereinafter, the interior connection of the components 20, 36, 60 allows for better alignment of the components 20, 36, 60, and additionally enables the components 20, 36, 60 to be more easily adjusted during the assembly process.

Figure 3:
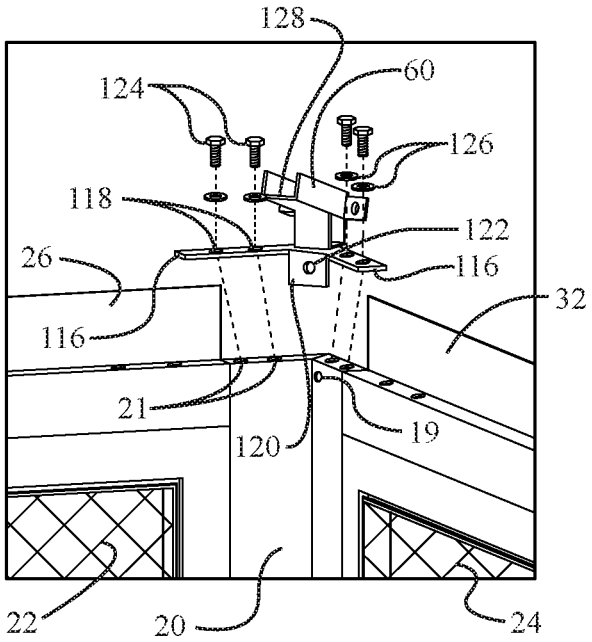
FIG. 3 is an enlarged, partial perspective view of the connection between one of the corner connecting members and one of the support post members of the portable shelter of FIG. 1.

With combined reference to FIGS. 3 and 8, the manner in which each corner connecting member 60 is connected to its respective corner support post member 20 will be described. As shown in FIG. 3, each corner support post member 20 comprises a plurality of fastener apertures 21 disposed in the top end thereof (e.g., four (4) fastener apertures 21 disposed in the top end thereof). Also, referring to FIGS. 3 and 8, it can be seen that each corner connecting member 60 comprises a pair of base mounting flanges 116 with a plurality of mounting apertures 118 therein (e.g., two (2) mounting apertures 118 disposed in each base mounting flange 116). Each of the mounting apertures 118 in the base mounting flanges 116 of the corner connecting member 60 generally corresponds to a respective fastener aperture 21 in the top end of the corner support post member 20. As shown in the connection detail of FIG. 3, in the exemplary embodiment, a plurality of bolts 124 and associated washers 126 are used to secure each corner connecting member 60 to the top end of its respective corner support post member 20 (e.g., four (4) bolts 124 and four (4) washers 126 for each corner assembly). The bolts 124 pass through the mounting apertures 118 in the base mounting flanges 116 of the corner connecting member 60, and are threadingly received within the fastener apertures 21 of the corner support post member 20 (i.e., each fastener aperture 21 is provided with internal threads therein to correspond to the external threads on each bolt 124).

Figure 4:
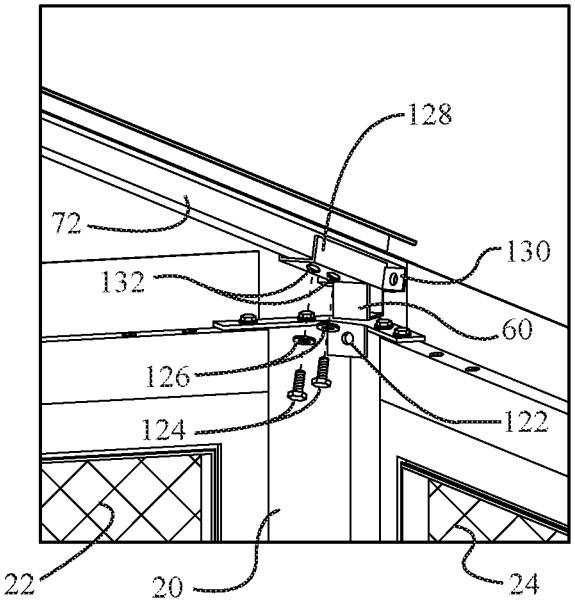
FIG. 4 is an enlarged, partial perspective view of the connection between one of the corner connecting members and one of the corner roof frame members of the portable shelter of FIG. 1.
Figure 8:
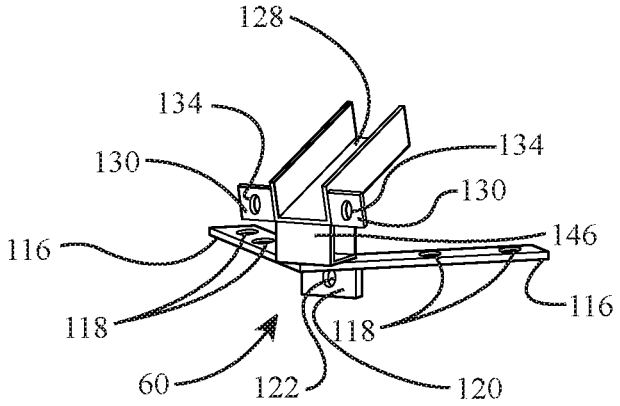
FIG. 8 is an enlarged perspective view of one of the corner connecting members of the portable shelter of FIG. 1.

Turning to FIGS. 4 and 8, the manner in which each corner connecting member 60 is connected to its respective corner roof frame member 72 will be explained. Each of the corner connecting members 60 further comprises a roof frame mounting tray 128 for supporting a respective corner roof frame member 72 of the roof frame structure of the portable shelter 100. As shown in FIGS. 4 and 8, the roof frame mounting tray 128 of the corner connecting member 60 is generally in the form of channel member with a C-shaped cross-section for receiving a tubular corner roof frame member 72 therein. As shown in the perspective view of FIG. 8, the roof frame mounting tray 128 is connected to the base mounting flanges 116 of the corner connecting member 60 by means of a middle support portion 146 of the corner connecting member 60. Like the roof frame mounting tray 128, the middle support portion 146 of the corner connecting member 60 has a generally C-shaped cross-section. Referring again to FIGS. 4 and 8, it can be seen that the roof frame mounting tray 128 is disposed at an acute angle relative to the base mounting flanges 116 of the corner connecting member 60 (i.e., the roof frame mounting tray 128 is upwardly sloped at an acute angle relative to the base mounting flanges 116). In FIG. 4, it can be seen that the bottom wall of the roof frame mounting tray 128 is provided with a plurality of mounting apertures 132 formed therein (e.g., two (2) mounting apertures 132 disposed therein). Each of the mounting apertures 132 in the bottom wall of the roof frame mounting tray 128 generally corresponds to a respective fastener aperture in the bottom surface of the corner roof frame member 72. As shown in the connection detail of FIG. 4, in the exemplary embodiment, a plurality of bolts 124 and associated washers 126 are used to secure each corner roof frame member 72 to its respective corner connecting member 60 (e.g., two (2) bolts 124 and two (2) washers 126 for each corner roof frame member 72). The bolts 124 pass through the mounting apertures 132 in the roof frame mounting tray 128 of the corner connecting member 60, and are threadingly received within the fastener apertures of the corner roof frame member 72 (e.g., each fastener aperture in the corner roof frame member 72 is provided with internal threads in an end portion of the corner roof frame member 72 that correspond to the external threads on each bolt 124).

Figure 5:
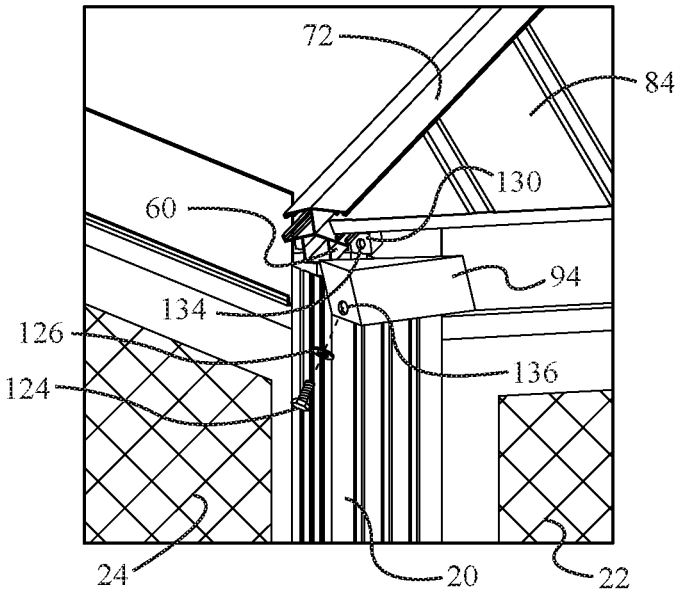
FIG. 5 is an enlarged, partial perspective view of the connection between one of the corner connecting members and one of the roof bracket members of the portable shelter of FIG. 1.
Figure 6:
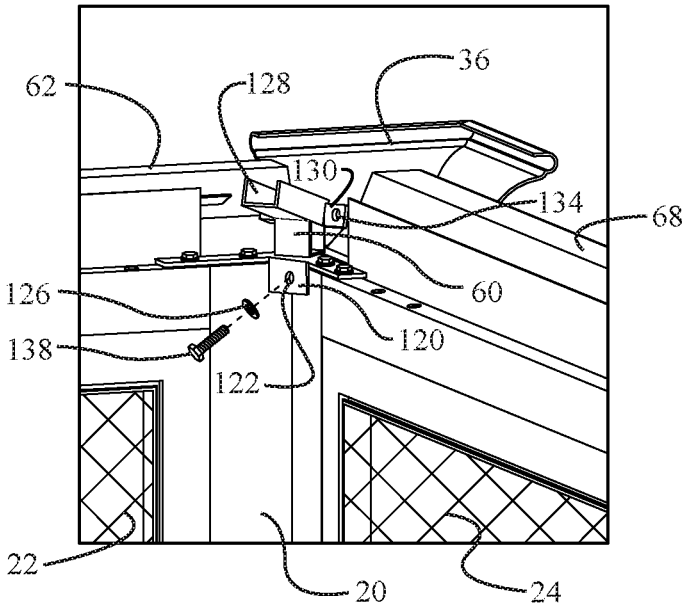
FIG. 6 is an enlarged, partial perspective view of the connection between one of the corner connecting members and one of the corner trim members of the portable shelter of FIG. 1.

With reference to FIGS. 2, 5, and 8, the manner in which each corner connecting member 60 is connected to the roof bracket members 92, 94 will now be described. As best shown in the perspective view of FIG. 8, it can be seen that each of the corner connecting members 60 further comprises a pair of side mounting flanges 130 for connecting the corner connecting member 60 to the roof bracket members 92, 94 of the portable shelter 100. In FIG. 8, it can be seen that the side mounting flanges 130 are disposed on opposite sides of the roof frame mounting tray 128 of the corner connecting member 60. Each side mounting flange 130 protrudes outwardly from its respective side of the roof frame mounting tray 128. In FIG. 8, it can be seen that each side mounting flange 130 is provided with a respective aperture 134 formed therethrough for attaching the corner connecting member 60 to each one of the roof bracket members 92, 94. For example, as shown in the connection detail of FIG. 5, the aperture 134 in the right side mounting flange 130 of the corner connecting member 60 corresponds to the aperture 136 in the roof bracket member 94. A first one of the side mounting flanges 130 is used to connect the first roof bracket member 92 to the corner connecting member 60, and a second one of the side mounting flanges 130 is used to connect the second roof bracket member 94 to the corner connecting member 60. For example, referring again to the detail of FIG. 5, a bolt 124 and associated washer 126 is used to secure the second roof bracket member 94 to its respective side mounting flange 130 of the corner connecting member 60. A similar bolt 124 and associated washer 126 is used to secure the first roof bracket member 92 to its respective side mounting flange 130 of the corner connecting member 60. In the exemplary embodiment, the bolts 124 pass through the apertures 136 in the roof bracket members 92, 94, and are threadingly received within the fastener apertures 134 of the side mounting flanges 130 of the corner connecting member 60 (e.g., the fastener apertures 134 in the side mounting flanges 130 may be provided with internal threads that correspond to the external threads on each bolt 124). Referring to the exploded view of FIG. 2, roof bracket members 96, 98 are connected to respective middle connecting members 58.

Figure 7:
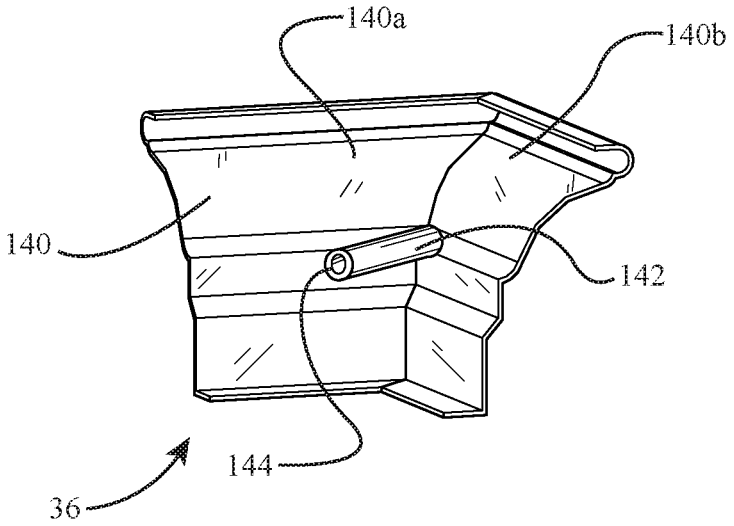
FIG. 7 is an enlarged perspective view of one of the corner trim members of the portable shelter of FIG. 1.

Referring now to FIGS. 6, 7, and 8, the manner in which each corner trim member 36 is connected to its respective corner connecting member 60 will be described in detail. As mentioned above, each corner connecting member 60 includes a downwardly extending flange 120 (see FIGS. 6 and 8) for connecting each corner trim member 36 to its respective corner connecting member 60. In FIGS. 6 and 8, it can be seen that the downwardly extending flange 120 extends downwardly from the middle portion of the corner connecting member 60. Also, as illustrated in these figures, it can be seen that the downwardly extending flange 120 is provided with fastener aperture 122 formed therethrough for attaching the corner connecting member 60 to the corner trim member 36. Turning to the perspective view of FIG. 7, it can be seen that the corner trim member 36 comprises a generally L-shaped body portion 140 formed by a first trim portion 140*a* and a second trim portion 140*b*. The first trim portion 140*a* of the generally L-shaped body portion 140 of the corner trim member 36 is disposed generally perpendicular to the second trim portion 140*b*. Also, as shown in FIG. 7, the corner trim member 36 further includes a fastener boss 142 extending outwardly from the intersection line between the first and second trim portions 140*a*, 140*b*. That is, the fastener boss 142 extends outwardly from the rear surface of the corner trim member 36 at the seam where the first trim portion 140*a* is joined to the second trim portion 140*b*. Turning to FIG. 3, it can be seen that, in order to accommodate the fastener boss 142 of the trim piece member 36 in the assembled state of the portable shelter 100, the corner support post member 20 comprises an aperture 19 disposed therethrough. The aperture 19 of the corner support post member 20 receives the fastener boss 142 of the corner trim member 36 therein when the corner trim member 36 is connected to the corner connecting member 60. Referring again to FIG. 7, it can be seen that the fastener boss 142 of the corner trim member 36 comprises a centrally disposed fastener aperture 144 formed therein. The centrally disposed fastener aperture 144 in the fastener boss 142 is configured to receive a fastener member (e.g., bolt 138—see FIG. 6) for securing the corner trim member 36 to the downwardly extending flange 120 of the corner connecting member 60. As shown in the connection detail of FIG. 6, the fastener aperture 122 in the downwardly extending flange 120 of the corner connecting member 60 corresponds to the fastener aperture 144 in the fastener boss 142 of the corner trim member 36. For example, referring again to the detail of FIG. 6, a bolt 138 and associated washer 126 is used to secure the corner trim member 36 to the downwardly extending flange 120 of the corner connecting member 60. In the exemplary embodiment, the bolt 138 passes through the fastener aperture 122 in the downwardly extending flange 120 of the corner connecting member 60, and is threadingly received within the fastener aperture 144 in the fastener boss 142 of the corner trim member 36 (e.g., the fastener aperture 144 in the fastener boss 142 may be provided with internal threads that correspond to the external threads on the bolt 138). Referring again to FIG. 6, it can be seen that the fastener boss 142 of the corner trim member 36 extends between ends of adjacent side trim members 62, 68 of the portable shelter 100 when the corner trim member 36 is secured to the corner connecting member 60. As described above, advantageously, the corner trim member 36 is able to be secured to the corner connecting member 60 by a user disposed in the interior of the portable shelter 100.

Now, with reference to FIGS. 1 and 2, the side coverings of the portable shelter or screen room 100 of the exemplary embodiment will be described. Initially, referring to FIG. 1, it can be seen that the sides of the portable shelter 100 are provided with a plurality of screen wall panels 22, 24 arranged at the corners of the portable shelter 100, and sliding screen doors 38, 40, 42, 44 disposed between the screen wall panels 22, 24. The first pair of screen doors 38, 40 are generally the same as the second pair of screen doors 42, 44, except that the screen doors 38, 40 are wider than the screen doors 42, 44 because they are disposed on the longer sides of the rectangular portable shelter 100. As best shown in the exploded view of FIG. 2, the first pair of screen doors 38, 40 are provided with base rail track members 10, 12 along the bottom, and upper rail track members 48, 50 along the top. Similarly, as shown in FIG. 2, the second pair of screen doors 42, 44 are provided with base rail track members 14, 16 along the bottom, and upper rail track members 52, 54 along the top. In FIG. 2, it can be seen that the longer base rail track members 10, 12 are connected to one another by means of a middle base rail connector 18, and similarly, the shorter base rail track members 14, 16 are connected to one another by means of a middle base rail connector 18. Each sliding screen door 38, 40, 42, 44 is provided with a plurality of door wheel assemblies 46 mounted thereon (e.g., one or more door wheel assemblies 46 mounted on the top and bottom of the sliding screen doors 38, 40, 42, 44—see FIG. 2). The door wheel assemblies 46, which are mounted on the sliding screen doors 38, 40, 42, 44, engage with the base rail track members 10, 12, 14, 16 and the upper rail track members 48, 50, 52, 54 so as to enable the sliding screen doors 38, 40, 42, 44 to slide within the upper and lower rail track members 10, 12, 14, 16, 48, 50, 52, 54. The upper rail track members 48, 50, 52, 54 are coupled together at adjoining corners by means of the rail block splice members 56.

As shown in FIGS. 1 and 2, in the exemplary embodiment, the portable shelter or screen room 100 is provided with side trim members 62, 64, 66, 68 that are hung from the crossbeam frame members 26, 28, 30, 32. The first pair of side trim members 62, 64 are generally the same as the second pair of side trim members 66, 68, except that the side trim members 62, 64 are longer than the side trim members 66, 68 because they are disposed on the longer sides of the rectangular portable shelter 100. In FIG. 2, it can be seen that the longer side trim members 62, 64 are connected to one another by means of a middle plate connector 102, and similarly, the shorter side trim members 66, 68 are also connected to one another by means of a middle plate connector 102. Also, the longer side trim members 62, 64 are connected to adjacent middle roof frame members 74, and the shorter side trim members 68 are also each connected to an adjacent middle roof frame member 74. After the side trim members 62, 64, 66, 68 have been installed on the portable shelter 100, the corner trim piece 36 is fitted over the exposed ends of the side trim members 62, 64, 66, 68, and mounted in the manner described above.

Next, referring again to FIGS. 1 and 2, the roof frame structure of the portable shelter or screen room 100 of the exemplary embodiment will be explained. In general, it can be seen that the plurality of roof frame members 72, 74, which extend from the eave to the peak of the portable shelter roof are circumferentially spaced apart from one another so as to form a supporting structure for a plurality of roof panels 78, 80, 82, 84, 86, 88. An upper end of each of the roof frame members 72, 74 is designed to be connected to a central roof connector 70 at the peak of the portable shelter roof by means of respective fasteners, such as bolts (see FIG. 2). In the exploded view of FIG. 2, it can be seen that the underside of the central roof connector 70 is provided with a hook member 76 attached thereto (e.g., the end portion of the hook member 76 may be provided with a plurality of external threads that matingly engage with a plurality of internal threads on the central roof connector 70). As an example, the hook member 76 may be used for holding a hanging plant or a light inside the portable shelter 100. Also, with combined reference to FIGS. 1 and 2, it can be seen that a central roof trim member 90 is provided on the top of the central roof connector 70 (i.e., mounted on the top of the central roof connector 70 using a plurality of fasteners, such as bolts) in order to maintain the weatherproof integrity of the portable shelter roof structure. Referring to the exploded view of FIG. 2, roof frame bars 104, 108 are connected to middle roof frame members 74, while roof frame bars 104, 106 are connected to corner roof frame members 72 by means of fasteners, such as bolts.

In the exemplary embodiment, the primary roof framing members include four (4) corner roof frame members 72 and six (6) middle roof frame members 74. As mentioned above, the roof itself of the portable shelter or screen room 100 is formed by a plurality of roof panels 78, 80, 82, 84, 86, 88. As depicted in FIGS. 1 and 2, the upper portion of the portable shelter roof is formed by a first subset of roof panels 78, 80, 82, which includes left side upper triangular roof panels 78, right side upper triangular roof panels 80, and middle upper roof panels 82. On the longer sides of the portable shelter 100, the middle upper roof panels 82 are disposed between paired upper triangular roof panels 78, 80, while on the shorter sides of the portable shelter 100, only adjacent upper triangular roof panels 78, 80 are provided (see FIG. 1). In the exemplary embodiment, the first subset of roof panels 78, 80, 82 may be formed from a suitable plastic or polymeric material, such as polycarbonate, and may be translucent or semi-translucent (e.g., so that natural sunlight may pass therethrough). Turning again to FIGS. 1 and 2, the lower portion of the portable shelter roof is formed by a second subset of roof panels 84, 86, 88, which includes left side lower trapezoidal roof panels 84, right side lower trapezoidal roof panels 86, and middle lower roof panels 88. On the longer sides of the portable shelter 100, the middle lower roof panels 88 are disposed between paired lower trapezoidal roof panels 84, 86, while on the shorter sides of the portable shelter 100, only adjacent lower trapezoidal roof panels 84, 86 are provided (see FIG. 1). In the exemplary embodiment, the second subset of roof panels 84, 86, 88 may be formed from a suitable metal or metallic material, such as steel, and may be opaque (e.g., so that natural sunlight does not pass therethrough). As shown in FIGS. 1 and 2, roof panel connecting members 110 are provided between adjacent upper triangular roof panels 78 and lower trapezoidal roof panels 84, roof panel connecting members 112 are provided between adjacent upper triangular roof panels 80 and lower trapezoidal roof panels 86, and roof panel connecting members 114 are provided between adjacent middle upper roof panels 82 and middle lower roof panels 88. Advantageously, roof panel connecting members 110, 112, 114 seal the portable shelter roof, and add structural rigidity to the portable shelter roof.

In one or more embodiments, the wall and roof framing components of the portable shelter 100 (e.g., as illustrated in FIGS. 1 and 2) are formed from a suitable metallic material, such as steel. However, those of ordinary skill in the art will appreciate that other suitable materials can be used for the various components of the portable shelter 100 as well.

It is readily apparent that the aforedescribed portable shelter 100 offers numerous advantages. First, the portable shelter 100 has a corner assembly that includes a plurality of components 20, 36, 60 that are capable of being assembled from the interior of the portable shelter 100 so that it is easier to align the components 20, 36, 60 as they are assembled (e.g., it is easier to align the corner support post member 20 from the inside). Secondly, the corner assembly of the portable shelter 100 described herein comprises a plurality of components 20, 36, 60 that are capable of being assembled from inside the portable shelter 100 so that adjustments may be readily made to the components 20, 36, 60 as they are assembled (e.g., it is easier to adjust the corner trim member 36 from the inside). Also, the interior assembly of the corner assembly components 20, 36, 60 also enables the components 20, 36, 60 to virtually self-adjust as they assembled. In addition, the aforedescribed corner assembly of the portable shelter 100 does not necessitate the use of exteriorly located fasteners, thereby enabling the fasteners 124, 138 to be protected from the weather elements and the portable shelter 100 to have an aesthetically pleasing exterior appearance.

Any of the features or attributes of the above described embodiments and variations can be used in combination with any of the other features and attributes of the above described embodiments and variations as desired.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description

The invention claimed is:

1. A corner assembly for a portable shelter, comprising:

a support post member having a top end and a bottom end oppositely disposed relative to said top end, said support post member including an aperture disposed therethrough, said support post member configured to support a roof frame structure of a portable shelter;

a corner connecting member coupled to said support post member, said corner connecting member including a downwardly extending flange extending along an interior side of said support post member;

a first side trim member having a first end and a second end oppositely disposed relative to said first end, said first side trim member extending along a first side of said portable shelter, and said first end of said first side trim member disposed proximate to said top end of said support post member;

a second side trim member having a first end and a second end oppositely disposed relative to said first end, said second side trim member extending along a second side of said portable shelter, and said first end of said second side trim member disposed proximate to said top end of said support post member; and a corner trim member coupled to said downwardly extending flange of said corner connecting member, said corner trim member including a generally L-shaped trim member formed by a first trim portion and a second trim portion, said first trim portion being disposed generally perpendicular to said second trim portion, said first trim portion of said corner trim member overlapping said first end of said first side trim member and said second trim portion of said corner trim member overlapping said first end of said second side trim member, said corner trim member further including a fastener boss extending from a rear surface of said corner trim member, said aperture of said support post member receiving said fastener boss of said corner trim member therein, said fastener boss of said corner trim member including a fastener aperture formed therein, said fastener aperture receiving a fastener member on said interior side of said support post member passing through said aperture of said support post member that secures said corner trim member to said downwardly extending flange of said corner connecting member, and said corner trim member configured to be secured to said corner connecting member by a user disposed in the interior of said portable shelter.

2. The corner assembly according to claim 1, wherein said fastener aperture of said fastener boss of said corner trim member is centrally disposed within said fastener boss, and said fastener aperture of said fastener boss comprises internal threads that correspond to external threads on said fastener member.

3. The corner assembly according to claim 1, wherein said fastener boss of said corner trim member extends between said first ends of said first and second side trim members of said portable shelter.

4. The corner assembly according to claim 1, wherein said fastener boss extends from the intersection line between said first and second trim portions of said corner trim member.

5. The corner assembly according to claim 1, wherein said support post member comprises one or more fastener apertures in said top end thereof, and wherein said corner connecting member further comprises one or more base mounting flanges with one or more mounting apertures therein, each of said one or more mounting apertures in said one or more base mounting flanges of said corner connecting member corresponding to said one or more fastener apertures in said top end of said support post member.

6. The corner assembly according to claim 1, wherein said corner connecting member further comprises a roof frame mounting tray configured to support one or more roof frame members of said roof frame structure of said portable shelter therein.

7. The corner assembly according to claim 1, wherein said corner connecting member further comprises at least one side mounting flange for coupling said corner connecting member to a roof bracket member.

8. A corner assembly for a portable shelter, comprising:

a support post member having a top end and a bottom end oppositely disposed relative to said top end, said support post member including an aperture disposed therethrough;

a corner connecting member configured to couple said support post member to one or more roof frame members of a portable shelter;

a first side trim member having a first end and a second end oppositely disposed relative to said first end, said first side trim member extending along a first side of said portable shelter, and said first end of said first side trim member disposed proximate to said top end of said support post member;

a second side trim member having a first end and a second end oppositely disposed relative to said first end, said second side trim member extending along a second side of said portable shelter, and said first end of said second side trim member disposed proximate to said top end of said support post member; and a corner trim member coupled to said corner connecting member, said corner trim member including a first trim portion and a second trim portion, said first trim portion of said corner trim member overlapping said first end of said first side trim member and said second trim portion of said corner trim member overlapping said first end of said second side trim member, said corner trim member further including a fastener boss extending from a rear surface of said corner trim member, said aperture of said support post member receiving said fastener boss of said corner trim member therein, said fastener boss of said corner trim member including a fastener aperture formed therein, said fastener aperture receiving a fastener member on an interior side of said support post member passing through said aperture of said support post member, and said corner trim member configured to be secured to said corner connecting member by a user disposed in the interior of said portable shelter.

9. The corner assembly according to claim 8, wherein said fastener aperture of said fastener boss of said corner trim member is centrally disposed within said fastener boss, and said fastener aperture of said fastener boss comprises internal threads that correspond to external threads on said fastener member.

10. The corner assembly according to claim 8, wherein said fastener boss of said corner trim member extends between said first ends of said first and second side trim members of said portable shelter.

11. The corner assembly according to claim 8, wherein said corner trim member comprises a generally L-shaped trim member formed by said first trim portion and said second trim portion, said first trim portion being disposed generally perpendicular to said second trim portion, and wherein said fastener boss extends from the intersection line between said first and second trim portions.

12. The corner assembly according to claim 8, wherein said corner connecting member comprises one or more base mounting flanges with one or more mounting apertures therein, each of said one or more mounting apertures in said one or more base mounting flanges of said corner connecting member corresponding to one or more fastener apertures in a top end of said support post member.

13. The corner assembly according to claim 8, wherein said corner connecting member comprises a roof frame mounting tray configured to support said one or more roof frame members of said portable shelter therein.

14. The corner assembly according to claim 8, wherein said corner connecting member comprises at least one side mounting flange for coupling said corner connecting member to a roof bracket member.

15. The corner assembly according to claim 8, wherein said corner connecting member comprises a downwardly extending flange coupling said corner connecting member to said corner trim member.

16. A corner assembly for a portable shelter, comprising:

a support post member having a top end and a bottom end oppositely disposed relative to said top end, and said support post member having an interior side disposed on an interior of a portable shelter, said support post member including an aperture disposed therethrough, said support post member configured to support a roof frame structure of said portable shelter;

a first side trim member having a first end and a second end oppositely disposed relative to said first end, said first side trim member extending along a first side of said portable shelter, and said first end of said first side trim member disposed proximate to said top end of said support post member;

a second side trim member having a first end and a second end oppositely disposed relative to said first end, said second side trim member extending along a second side of said portable shelter, and said first end of said second side trim member disposed proximate to said top end of said support post member; and a corner trim member coupled to said support post member, said corner trim member including a first trim portion and a second trim portion, said first trim portion of said corner trim member overlapping said first end of said first side trim member and said second trim portion of said corner trim member overlapping said first end of said second side trim member, said corner trim member further including a fastener boss extending from a rear surface of said corner trim member, said aperture of said support post member receiving said fastener boss of said corner trim member therein, said fastener boss of said corner trim member including a fastener aperture formed therein, said fastener aperture receiving a fastener member on said interior side of said support post member passing through said aperture of said support post member, and said corner trim member configured to be coupled to said support post member by a user disposed in said interior of said portable shelter.

17. The corner assembly according to claim 16, wherein said fastener aperture of said fastener boss of said corner trim member is centrally disposed within said fastener boss, and said fastener aperture of said fastener boss comprises internal threads that correspond to external threads on said fastener member.

* * * * *